US007908669B2

(12) United States Patent
Amson

(10) Patent No.: US 7,908,669 B2
(45) Date of Patent: Mar. 22, 2011

(54) CLOTHING PROTECTOR SCARF

(76) Inventor: Bonnie Amson, Tampa, FL (US)

( * ) Notice: Subject to any disclaimer, the term of this patent is extended or adjusted under 35 U.S.C. 154(b) by 0 days.

(21) Appl. No.: 11/768,272

(22) Filed: Jun. 26, 2007

(65) Prior Publication Data

US 2009/0000005 A1 Jan. 1, 2009

(51) Int. Cl.
*A41B 13/10* (2006.01)
*A41D 23/00* (2006.01)

(52) U.S. Cl. ..... 2/49.1; 2/207

(58) Field of Classification Search ..... 2/49.1–49.5, 2/91, 50, 51, 52, 48, 46, 49.4, 69, 92, 102, 2/103, 144, 145, 146, 88, 104, 207, 208; D2/861, 500
See application file for complete search history.

(56) References Cited

U.S. PATENT DOCUMENTS 552,670 A * 1/1896 Riess ..... 2/91
816,231 A * 3/1906 Hill et al. ..... 2/91
830,482 A * 9/1906 Lungren ..... 2/91
856,720 A * 6/1907 Neuman ..... 2/91
968,199 A * 8/1910 Schwartz ..... 2/91
1,797,226 A * 3/1931 Chumbley ..... 2/91
2,237,368 A * 4/1941 Seitzman et al. ..... 2/91
2,247,272 A * 6/1941 Becher ..... 2/91
2,303,383 A * 12/1942 Norton ..... 2/102
2,355,290 A * 8/1944 Gold ..... 2/91
2,402,996 A * 7/1946 Whitcomb ..... 2/91
2,496,953 A * 2/1950 Pinnere ..... 2/91
2,507,333 A * 5/1950 Coursey ..... 2/91
2,620,478 A * 12/1952 Fraum ..... 2/91
2,804,626 A * 9/1957 Rossiter ..... 2/91
2,832,075 A * 4/1958 Davidson ..... 2/91
2,870,448 A * 1/1959 Rosenthal ..... 2/91
3,016,544 A * 1/1962 Pinkney ..... 2/49.1
3,286,276 A * 11/1966 Calisch ..... 2/91
3,479,667 A * 11/1969 Mehl ..... 2/65
3,894,296 A * 7/1975 Hirschbeck ..... 2/144
3,914,797 A * 10/1975 Stembridge ..... 2/48
4,654,897 A * 4/1987 Rosaen ..... 2/207
4,797,953 A * 1/1989 Dameron ..... 2/104
5,797,144 A * 8/1998 Ciccone ..... 2/144
D448,540 S * 10/2001 Smith ..... D2/502
2010/0011478 A1 * 1/2010 Ekelund et al. ..... 2/49.1

* cited by examiner

*Primary Examiner* — Amy B Vanatta
(74) *Attorney, Agent, or Firm* — Greenberg Traurig LLP

(57) ABSTRACT

A clothing protector scarf that is worn around the neck and drapes over one's chest on two sides, from the neck to at, or slightly above, one's waist When not used for dining, or other purposes of clothing protection, the two sections of the scarf remain separated and the scarf is worn as a decorative fashion accessory. When dining, the two sections of the scarf may be joined together along their leading edges with hook and loop (Velcro) fasteners, forming a continuous surface of fabric capable of keeping food from coming in contact with the clothing underneath.

14 Claims, 2 Drawing Sheets

CLOTHING PROTECTOR SCARF

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates to scarves and, more particularly, to a scarf that functions as a bib, or similar means of protecting clothing.

BACKGROUND OF THE INVENTION

Most people require that their clothing be protected during certain activities. These include, but are not limited to, dining, applying makeup and burping babies. The handicapped and elderly, especially those suffering from disorders that affect motor functioning, are particularly susceptible to spillage when dining or engaging in other activities requiring fine motor competence. The most typical solutions designed for protecting clothing have been the use of various bibs, scarves, wraps and napkins.

The major shortcomings of other bibs, scarves, wraps and napkins are their limited utility as fashion accessories, limited versatility as protective garments or the potentially unwanted attention they bring to the wearer, especially in public. They are typically not designed to be worn as accessories for other garments in public nor they are typically designed for purposes other than clothing protection. In addition, many people, such as the handicapped and elderly, find that wearing a bib or napkin while, for example, dining in public results in bringing unwanted attention to their deficits, resulting in feelings of diminished self-respect and loss of dignity.

OBJECTS AND SUMMARY OF THE INVENTION

It is object of the invention to protect clothing while dining or engaging in other activities that may result in spilling or soiling.

It is another object of the invention to serve as a decorative fashion accessory when not being used as a clothing protector.

In one embodiment, the invention is a clothing protector scarf that is worn around the neck and drapes over one's chest on two sides, from the neck to at, or slightly above, one's waist When not used for dining, or other purposes of clothing protection, the two sections of the scarf remain separated and the scarf is worn as a decorative fashion accessory. When dining, the two sections of the scarf may be joined together along their leading edges with hook and loop (Velcro) fasteners, forming a continuous surface of fabric capable of keeping food from coming in contact with the clothing underneath.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

For purposes of clarity and brevity, like elements and components will bear the same designations and numbering throughout the Figures.

DETAILED DESCRIPTION

Figure 1:
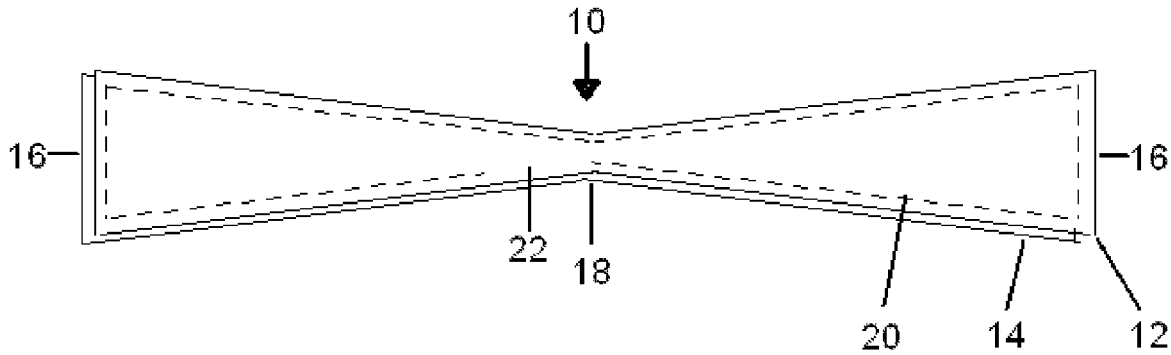
FIG. 1 is a front detail view of an embodiment of a clothing protector scarf fabric components, displayed horizontally, comprising of two sheets of fabric.

FIG. 1 is a front detail view of an embodiment of clothing protector scarf fabric components 10, displayed horizontally. There is provided a front layer elongated fabric member 12 and a back layer elongated fabric member 14. Each is generally hourglass shaped, preferably in the range of 55" in length with a wide end 16 preferably in the range of 8" in width and a narrow end 18 of preferably in the range of 3" in width. The clothing protector scarf fabric components 10 can incorporate shorter fabric members to construct a garment more suitable for children and small adults. In this smaller embodiment, the front layer elongated fabric member 12 and back layer elongated fabric member 14 would have lengths preferably in the range of 45" each. The front elongated fabric member and back elongated fabric member are joined together with single seam stitching 20, preferably in the range of ½" from the outer edge of the fabric members. After stitching 20, the fabric is pulled inside-out through a stitching gap 22 of 2½" to 3" in length.

Figure 2:
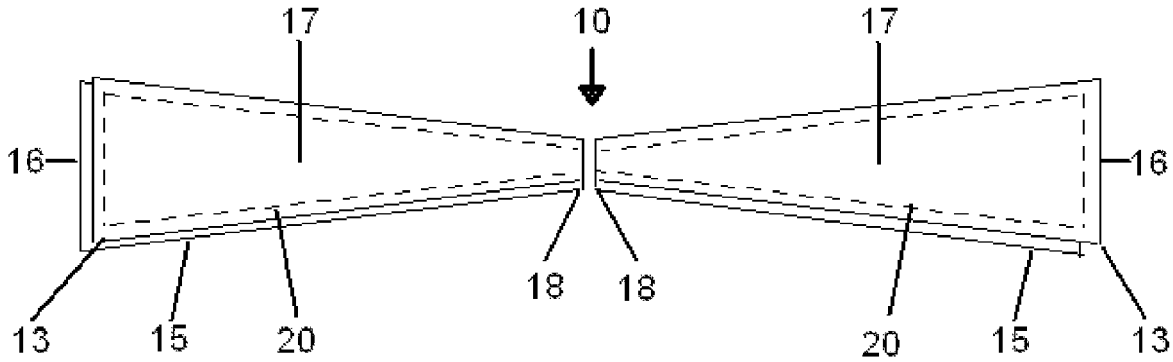
FIG. 2 is a front detail view of an embodiment of a clothing protector scarf fabric components, displayed horizontally, comprising of four sheets of fabric.

An alternate method of construction is shown in FIG. 2, which is a front detailed view of the clothing protector scarf fabric component 10, displayed horizontally, comprising of four sheets of fabric. This alternate method of construction uses four fabric members, instead of two. There is provided a front layer fabric member 13 (two each) and a. back layer fabric member 15 (two each). Each generally wedge shaped, preferably in the range of 28" in length, each with a wide end 16 preferably in the range of 8" in width and a narrow end 18 of preferably in the range of 3" in width. The clothing protector scarf fabric components 10 can incorporate shorter fabric members to construct a garment more suitable for children and small adults. In this smaller embodiment, the front layer fabric member 13 and back layer fabric member 15 would have lengths preferably in the range of 23" each. The front layer fabric member 13 and back layer fabric member 15 are joined together with single seam stitching 20, preferably in the range of ½" from the outer edge of the fabric members. After stitching 20, the fabric is pulled inside-out through the gap at the narrow end 18, producing a scarf half 17. This alternate method of assembly is conducive to pulling the joined fabric members inside-out when the front layer fabric member 13 and/or the back layer Fabric member 15 is comprised of a heavier material such as terrycloth. A stitching gap 22 is not required for this alternate assembly method.

Figure 3:
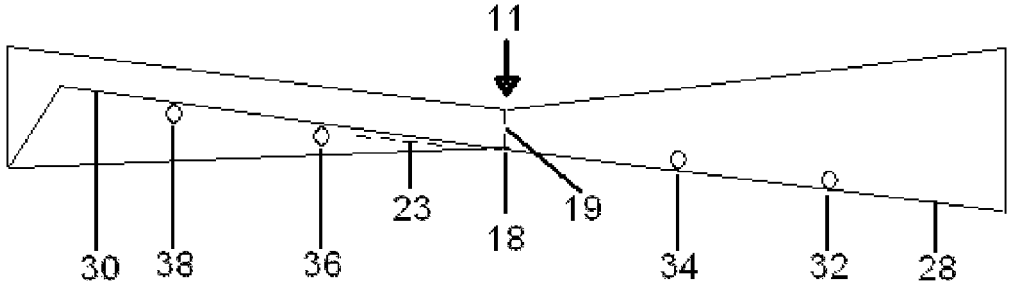
FIG. 3 is a front detail view of an embodiment of a clothing protector scarf, completed, displayed horizontally with left side Velcro loop fasteners showing; and right side (from wearer's perspective) folded back to reveal backside Velcro hook fasteners.

FIG. 3 is a front detail view of an embodiment of the clothing protector scarf 11, completed and displayed horizontally. The Velcro fasteners described in this description are of the iron-on variety. There is provided a lower left Velcro loop fastener 32 (Note: left, right, back and front references are from the wearer's perspective) preferably in the range of ½" in diameter, located along the front of the left side inner edge 28, preferably in the range of 15" from the narrow end 18 and flush with the left side inner edge 28. There is provided an upper left Velcro loop fastener 34 preferably in the range of ½" in diameter, located along the back front of the left side inner edge 28, preferably in the range of 10" from the narrow end 18 and flush with the left side inner edge 28. There is provided a lower right Velcro hook fastener 38 preferably in the range of ½" in diameter, located along the back side of the right side inner edge 30, preferably in the range of 15" from the narrow end 18 and flush with the right side inner edge 30. There is provided an upper right Velcro hook fastener 36 preferably in the range of ½" in diameter, located along back side of the right side inner edge 30, preferably in the range of 10" from the narrow end 18 and flush with the right side inner edge 30. If the clothing protector scarf 11 is constructed using the fabric components as depicted in FIG. 1, gap stitching 23 is required. The gap stitching 23 is a single seam. preferably in the range of ⅛" from the outer edge. If the clothing protector scarf 11 is constructed using the fabric components as depicted in FIG. 2, narrow end stitching 19 is required. The narrow end stitching 19 is a single seam joining each scarf half 17 (FIG. 2) at the narrow end 18. In another embodiment of a clothing protector scarf 11, the right and left loop and hook fasteners can be interchanged. The sidedness of the fasteners is not critical as long as the loop fasteners are on one side and the hook fasteners are on the other_ In another embodiment of a clothing protector scarf 11, the Velcro fasteners can be replaced with an alternate fastening method such as buttons and buttonholes or small metal hooks.

Figure 4:
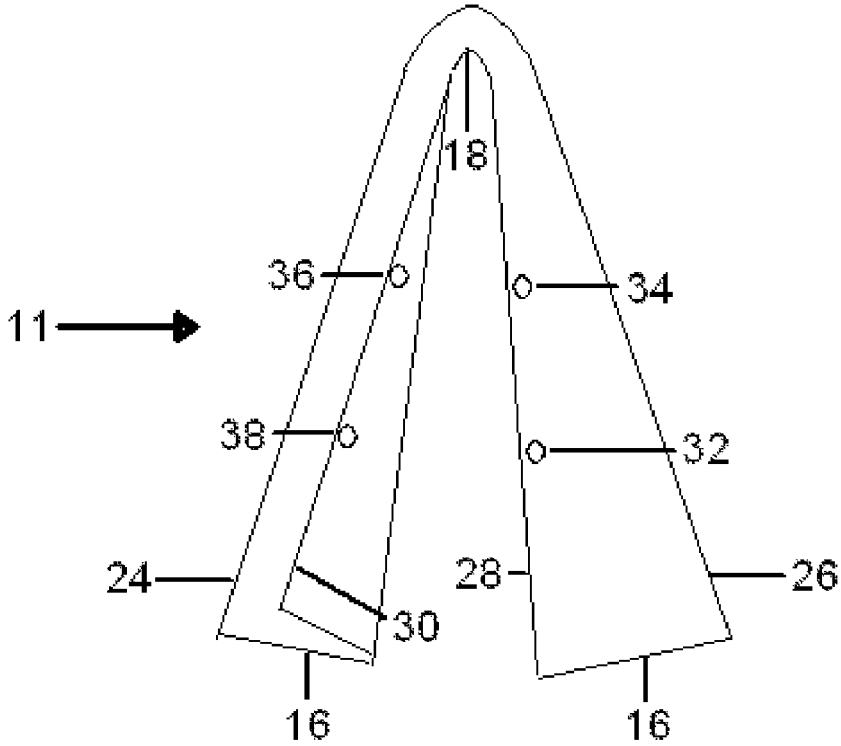
FIG. 4 is a front detail view of an embodiment of a clothing protector scarf, as it would appear when worn around the wearer's neck, draping down the wearer's chest, with left side Velcro loop fasteners showing and right side (from wearer's perspective) folded back to reveal back side Velcro hook fasteners.

FIG. 4 is a front detail view of an embodiment of the clothing protector scarf 11, as it would appear when worn around the neck and draping over the wearer's chest. The lower left Velcro loop fastener 32 and upper left Velcro loop fastener 34 are shown in relation to the narrow end 18 (which rests on the back of the wearer's neck) and the left side inner edge 28 and left side outer edge 26. The lower right Velcro hook fastener 38 and upper right Velcro hook fastener 36 are shown in relation to the narrow end 18 and right side outer edge 24 and right side inner edge 30 (folded back to reveal the fasteners).

Figure 5:
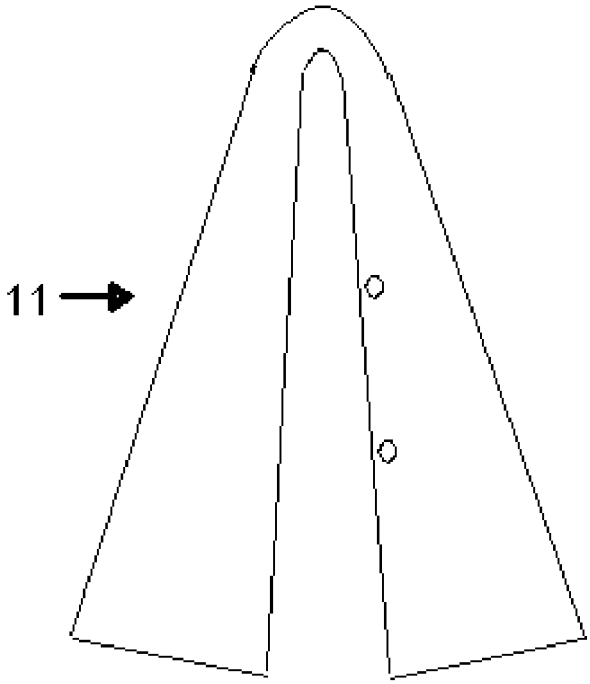
FIG. 5 is a front perspective view of an embodiment of a clothing protector scarf, as it would appear when worn as decorative garment in accordance with the invention.

FIG. 5 is a front perspective view of an embodiment of the clothing protector scarf 11, as it would appear when worn as decorative garment in accordance with invention.

Figure 6:
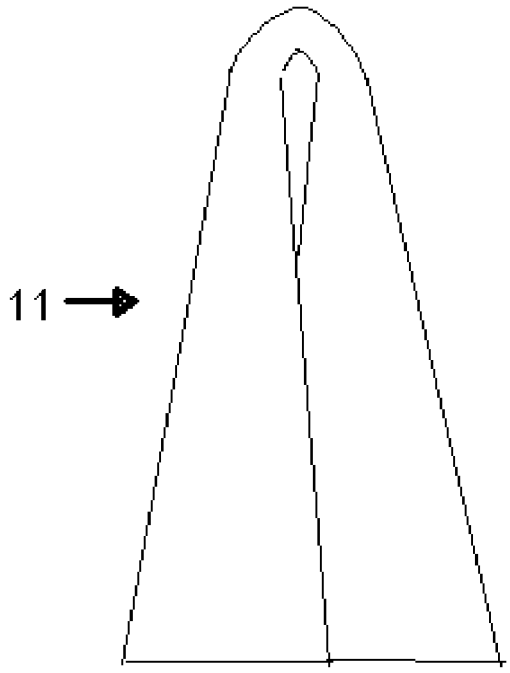
FIG. 6 a front perspective view of an embodiment of a clothing protector scarf as it would appear when worn and fastened to form a continuous surface protective garment in accordance with the invention.

FIG. 6 is a front perspective view of an embodiment clothing protector scarf 11 as it would appear when worn and fastened to form a continuous surface protective garment in accordance with the invention.

While the invention has been particularly shown and described with reference to preferred embodiments thereof, it will be understood by those skilled in the art that various changes in form and details may be made therein without departing from the spirit and scope of the invention. For example, the scarf could be constructed using a single elongated fabric member. The fabric used for such an embodiment would preferable be thicker and more absorbent than fabric used in a two layer embodiment.

I claim:

1. A scarf for protecting clothing while dining or engaging in other activities that may result in spillage on, or soiling of clothing, comprising:

a first elongated fabric member having a first side and a second side, having a first edge and a second edge, and having a first end and a second end;

a second elongated fabric member having a first side and a second side, having a first edge and a second edge, and having a first end and a second end, the second fabric member being attached to the first fabric member such that the second fabric member substantially covers the second side of the first fabric member and the first fabric member substantially covers the second side of the second fabric member such that the first end of the first fabric member is approximately opposite to the first end of the second fabric member and second end of the first fabric member is approximately opposite to the second end of the second fabric member;

a first plurality of fastening devices attached to the first side of the first fabric member, each of the first plurality of fastening devices being substantially flush with the first edge of the first elongated fabric member; and a second plurality of fastening devices attached to the first side of the second fabric member, each of the second plurality of fastening devices being substantially flush with the first edge of the second elongated fabric member, such that the first plurality of fastening devices on the first side of the first fabric member are able to be connected to the second plurality of fastening devices on the first side of the second fabric member such that the first fabric member and the second fabric member form a loop, wherein the loop is of a sufficient size to be worn around the neck of a person, and the first and second ends of the first fabric form a continuous surface protective garment, and wherein the scarf is configured to be wearable as a decorative accessory when the first plurality of fastening devices is not connected to the second plurality of fastening devices, and wherein the first elongated fabric member and the second elongated fabric member are approximately hour glass shaped, such that the ratio of the first end and the second end of the first elongated fabric member and the first end and the second end of the second elongated fabric member to the width of the center of the first elongated fabric member and the second elongated fabric member is approximately 8 to 3.

2. The scarf of claim 1 wherein the first elongated fabric member and the second elongated fabric member are approximately 45" to 55" in length, the first end and the second end of the first elongated fabric member and the second elongated fabric member are approximately 8" in width and the center of the first elongated fabric member and the second elongated fabric member are approximately 3" in width.

3. The scarf of claim 1 wherein the first elongated fabric member comprises two elongated fabric members joined end-to-end and the second elongated fabric member comprises two elongated fabric members joined end-to-end.

4. The scarf of claim 1 wherein the first plurality of fastening devices are loop fasteners and second plurality of fastening devices are hook fasteners.

5. The scarf of claim 1 wherein the first plurality of fastening devices are buttons and second plurality of fastening devices are button holes.

6. The scarf of claim 1 wherein the first plurality of fasteners and the second plurality of fasteners are not visible when first plurality of fasteners are connected to the second plurality of fasteners.

7. The scarf of claim 2 wherein the first plurality of fastening devices are loop fasteners and second plurality of fastening devices are hook fasteners wherein at least one loop fastener and at least one hook fastener is placed approximately 10 inches from the center of the first elongated fabric member and the center of the second elongated fabric member, and wherein at least a second loop fastener and at least a second hook fastener is placed approximately 15 inches from the center of the first elongated fabric member and the center of the second elongated fabric member.

8. A scarf for protecting clothing while dining or engaging in other activities that may result in spillage on, or soiling of clothing, comprising:

a single elongated fabric member having a first side and a second side, having a first edge and a second edge, and having a first end and a second end;

a first plurality of fastening devices attached to the first side of the fabric member, each of the first plurality of fastening devices being substantially flush with the first edge of the elongated fabric member; and a second plurality of fastening devices attached to the second side of the fabric member, each of the second plurality of fastening devices being substantially flush with the first edge of the elongated fabric member, such that the plurality fastening devices on the first side of the fabric member are able to be connected to the plurality of fastening devices on the second side of the fabric member such that the fabric member forms a loop, wherein the loop is of a sufficient size to be worn around the neck of a person, and the first and second ends of the fabric member form a continuous surface protective garment, and wherein the scarf is configured to be wearable as a decorative accessory when the first plurality of fastening devices is not connected to the second plurality of fastening devices, wherein the elongated fabric member is approximately hour glass shaped, such that the ratio of the width of the first end and the second end of the elongated fabric member to the width of the center of the elongated fabric member is approximately 8 to 3.

9. The scarf of claim 8 wherein the elongated fabric member wherein the elongated fabric member is approximately 45" to 55" in length and the first end and the second end of the elongated fabric member are is approximately 8" in width and the center of the elongated fabric member is approximately 3" in width.

10. The scarf of claim 8 wherein the elongated fabric member comprises two elongated fabric members joined end-to-end.

11. The scarf of claim 8 wherein the first plurality of fastening devices are loop fasteners and second plurality of fastening devices are hook fasteners.

12. The scarf of claim 8 wherein the first plurality of fastening devices are buttons and second plurality of fastening devices are button holes.

13. The scarf of claim 8 wherein the first plurality of fasteners and the second plurality of fasteners are not visible when first plurality of fasteners are connected to the second plurality of fasteners.

14. The scarf of claim 9 wherein the first plurality of fastening devices are loop fasteners and second plurality of fastening devices are hook fasteners wherein at least one loop fastener and at least one hook fastener is placed in the range of approximately 10 inches from the center of the elongated fabric member, and wherein at least a second loop fastener and at least a second hook fastener is placed approximately 15 inches from the center of the elongated fabric member.

* * * * *